US009875729B2

(12) United States Patent
Allendorph

(10) Patent No.: US 9,875,729 B2
(45) Date of Patent: Jan. 23, 2018

(54) ELECTRONIC MUTE FOR MUSICAL INSTRUMENT

(71) Applicant: Carl J. Allendorph, LLC, Pasadena, CA (US)

(72) Inventor: Carl J. Allendorph, Pasadena, CA (US)

(73) Assignee: Carl. J. Allendorph, LLC, Pasadena, CA (US)

( * ) Notice: Subject to any disclaimer, the term of this patent is extended or adjusted under 35 U.S.C. 154(b) by 0 days.

(21) Appl. No.: 15/583,844

(22) Filed: May 1, 2017

(65) Prior Publication Data

US 2017/0236502 A1 Aug. 17, 2017

Related U.S. Application Data

(63) Continuation of application No. 15/005,914, filed on Jan. 25, 2016, now Pat. No. 9,640,152.

(Continued)

(51) Int. Cl.
*G10D 9/06* (2006.01)
*H04R 1/46* (2006.01)

(Continued)

(52) U.S. Cl.
CPC ..... *G10D 9/06* (2013.01); *G10H 1/0008* (2013.01); *G10H 1/043* (2013.01); *H04R 1/08* (2013.01);

(Continued)

(58) Field of Classification Search
CPC ..... G10D 9/06

(Continued)

(56) References Cited

U.S. PATENT DOCUMENTS 1,467,422 A * 9/1923 Romeo ..... G10D 9/00 84/400
1,697,707 A * 1/1929 Berg ..... G10D 9/06 84/400

(Continued)

OTHER PUBLICATIONS

Keith Stead, Electronic Practice Mutes, Smooth Jazz . . . and more, http://www.keithstead.com/and_more/reviews/practice_mutes.html, accessed online Jan. 25, 2016.

(Continued)

*Primary Examiner* — David Warren
(74) *Attorney, Agent, or Firm* — Richard C. Galati; Holland & Hart LLP

(57) ABSTRACT

Methods for using at least one musical instrument mute for electronic modification of sound emitted from a musical instrument. A mute body is positionable within a bell or horn of the musical instrument, and the body has a proximal end portion and is configured to at least partially occlude the bell or horn. A microphone is positioned at the proximal end portion of the mute body and is configured to transduce a sound produced by the musical instrument. A speaker is positioned in the mute body as well. A microcontroller is configured to receive a signal from the microphone and to electronically modify the sound of the instrument when emitted through the speaker. Some mutes also provide a communication transceiver, sensors, and input devices to remotely control and manipulate sound produced by the mute.

21 Claims, 7 Drawing Sheets

Related U.S. Application Data

(60) Provisional application No. 62/107,233, filed on Jan. 23, 2015.

(51) Int. Cl.
*H04R 1/08* (2006.01)
*G10H 1/043* (2006.01)
*G10H 1/00* (2006.01)

(52) U.S. Cl.
CPC ..... *H04R 1/46* (2013.01); *G10H 2210/265* (2013.01); *G10H 2220/395* (2013.01); *G10H 2240/211* (2013.01)

(58) Field of Classification Search
USPC ..... 84/622, 400
See application file for complete search history.

(56) References Cited

U.S. PATENT DOCUMENTS 1,777,823 A * 10/1930 Bernard ..... G10D 9/06 84/400
2,108,769 A * 2/1938 Humes ..... G10D 9/06 174/102 SC
2,574,591 A * 11/1951 Rudd ..... G10D 9/06 84/400
2,690,092 A * 9/1954 Martin ..... G10D 9/06 84/400
3,299,764 A * 1/1967 Ventura ..... G10D 9/06 84/400
3,456,062 A * 7/1969 Watson ..... G10H 5/002 134/115 R
3,506,773 A * 4/1970 George ..... G10H 1/02 84/699
3,510,564 A * 5/1970 Wetsell ..... G10D 9/00 84/723
3,555,956 A * 1/1971 Martin ..... G10H 3/00 84/400
4,226,162 A * 10/1980 Ebach ..... G10D 9/06 181/131
4,273,022 A * 6/1981 Bell ..... G10D 9/06 84/400
4,915,008 A * 4/1990 Sakashita ..... G10H 1/00 84/658
5,149,904 A * 9/1992 Kamiya ..... G10H 1/02 84/395
5,569,864 A * 10/1996 Hamanaga ..... G10D 9/06 84/400
5,808,218 A * 9/1998 Grace ..... G10D 9/005 84/384
5,973,246 A * 10/1999 Hamanaga ..... G10D 9/06 84/400
6,114,619 A * 9/2000 Thompson ..... G10D 9/06 84/400
6,881,890 B2 * 4/2005 Sakurada ..... G10H 5/005 84/654
9,251,774 B2 * 2/2016 Shinoda ..... G10H 1/0091
2003/0209131 A1 * 11/2003 Asahi ..... G09B 15/023 84/485 R
2004/0144239 A1 * 7/2004 Sakurada ..... G10H 5/005 84/616
2005/0056139 A1 * 3/2005 Sakurada ..... G10H 5/005 84/616
2005/0076774 A1 * 4/2005 Sakurada ..... G10H 1/0016 84/616
2005/0217464 A1 * 10/2005 Onozawa ..... G10H 1/055 84/723
2006/0000347 A1 * 1/2006 Preece ..... G10H 1/36 84/741
2009/0071317 A1 * 3/2009 Nicoll ..... G10H 1/32 84/726
2013/0047818 A1 * 2/2013 Hamanaga ..... G10D 9/06 84/400
2014/0090544 A1 * 4/2014 Shinoda ..... G10H 1/0091 84/615
2016/0049138 A1 * 2/2016 Adkins ..... G10D 7/10 84/400
2016/0217774 A1 * 7/2016 Allendorph ..... G10D 9/06

OTHER PUBLICATIONS

Best Brass Corp., e-Brass IV, http://www.bestbrass.com/stf/e-brass.html, accessed online Jan. 25, 2016.

* cited by examiner

ELECTRONIC MUTE FOR MUSICAL INSTRUMENT

CROSS REFERENCE TO RELATED APPLICATIONS

This document claims benefit of priority to U.S. patent application Ser. No. 15/005,914, filed 25 Jan. 2016, which claimed benefit of priority to U.S. Provisional Patent Application No. 62/107,233, filed 23 Jan. 2015, and the entire disclosures of these applications are hereby incorporated by reference in this document.

TECHNICAL FIELD

The present disclosure generally relates to a mute apparatus for a musical instrument enabled to electronically modify and reproduce the sound produced by the instrument and related methods.

BACKGROUND

A mute for a musical instrument is a device fitted to the instrument to change the sound produced by the instrument, such as by altering the timbre and/or reducing the volume of the sound. For brass instruments such as trumpets, tubas, bugles, and trombones, a mute body is inserted into or attached to the bell of the instrument to block and absorb at least some of the sound coming through the bell opening. In some of these mutes, the absorption of sound may change the tone, may introduce mute-generated effects such as "wah-wah" or buzzing, or may emphasize a range of pitches coming from the instrument (e.g., enhanced treble). Musicians may also use mutes to reduce sound levels for more discreet practice sessions. Many mutes are simply attached to or held stationary in the bell, and others are manipulated by the musician to dynamically change the sound, such as, for example, a plunger mute that is cupped in the musician's hand and flapped against and away from the bell while the instrument is in use.

In conventional mutes, there are clear limits on the types of sounds that may be created. These limits may be based on the acoustic properties of the mute and the instrument itself. In order to control or change the sound coming from the instrument, the musician must manipulate the mute or exchange it. This may be difficult or impossible to do quickly and reliably, such as while performing or while the mute is inserted into a difficult to reach part of the instrument, such as within a tuba horn. Having multiple mutes for the same instrument may also be expensive and may take up additional space in carrying cases and other limited spaces. Furthermore, there is a wide variety of electronic sounds and filters that cannot be produced using existing mutes. There is, therefore, a present need for improvements in musical instrument mutes.

SUMMARY

One aspect of the present disclosure relates to a musical instrument mute. The mute may comprise a mute body positionable within a bell or horn of a musical instrument, wherein the body may have a proximal end portion and may be configured to at least partially occlude the bell or horn. A microphone may be positioned at the proximal end portion of the mute body and configured to transduce a sound produced by the musical instrument. A speaker may be positioned in the mute body, and a microcontroller may be configured to receive a signal from the microphone and may electronically modify the sound of the instrument when emitted through the speaker.

In some embodiments, the mute body may completely occlude the bell or horn of the musical instrument. The proximal end portion of the mute body may be at least partially conical. The mute body may be attachable to the musical instrument using a friction fit, interference fit, or negative pressure fit. A distal end portion of the mute body may comprise a rotatable ring configured to provide control of the microcontroller. The rotatable ring may extend circumferentially around the distal end portion of the mute body. The mute may further comprise a sensor configured to detect the position of the rotatable ring relative to the mute body.

A distal end portion of the mute body may comprise a plurality of rotatable rings configured to control the electronic modification of the sound of the musical instrument by the microcontroller. A gyroscopic sensor may also be included in the mute, and the microcontroller may be configured to electronically modify the sound of the musical instrument based on a signal received from the gyroscopic sensor. An accelerometer may also be included in the mute, and the microcontroller may be configured to electronically modify the sound of the musical instrument based on a signal received from the accelerometer. A barometric pressure sensor may be included in the mute as well, wherein the microcontroller may be configured to electronically modify the sound of the musical instrument based on a signal received from the barometric pressure sensor. The musical instrument mute may further comprise a wireless transceiver connected to the microcontroller and configured to receive control signals that are configured to control the microcontroller.

The mute body may be positionable within the bell or horn of a brass or woodwind instrument. The musical instrument mute may further comprise an outer microphone positioned on the mute body and configured to transduce a sound produced external to the musical instrument. Electronic modification of the sound of the instrument may comprise recording a first sound of the instrument and emitting the first sound through the speaker. This first sound may be emitted on a loop. The musical instrument mute may further comprise a lighted indicator configured to indicate settings of the microcontroller or to indicate characteristics of the sound generated by the musical instrument. The mute body may comprise a plurality of circumferentially spaced pads at least partially insertable into the bell or horn.

In another aspect of the disclosure, a musical instrument mute system is provided, comprising a mute body attachable to a musical instrument, wherein the mute body has a microphone and a speaker. A microcontroller may be connected to the microphone and configured to electronically modify the sound of the instrument when emitted through the speaker. A wireless transceiver may be connected to the microcontroller, wherein the wireless transceiver may be configured to receive a control signal from a remote device. The microcontroller may electronically modify the sound of the instrument based on the control signal from the remote device.

The musical instrument mute system may further comprise the remote device. This remote device may be another musical instrument mute having another wireless transceiver. The remote device may also be a remote controller. The remote device may comprise at least one gyroscopic sensor, accelerometer, or barometric pressure sensor. The remote device may also comprise a foot pedal. The remote device may be attachable to the musical instrument. A microphone may be positioned on the mute body to be inserted into the musical instrument and the speaker may be positioned on the mute body to emit sound external to the musical instrument.

In yet another aspect of the disclosure, a musical instrument having a mute apparatus is set forth. The musical instrument may have a bell or horn and an interior space within the bell or horn. The mute may be positioned within the bell or horn. A microphone may be positioned within the interior space of the musical instrument, and a processor may be configured to receive a signal from the microphone and to generate an electronic reproduction of the signal. A speaker positioned on the mute and connected to the processor may be used to emit the electronic reproduction of the signal.

In some arrangements, the musical instrument may be a brass or woodwind instrument.

In another aspect of the disclosure, a method of controlling an electronic mute for a musical instrument is provided. The method may comprise providing a musical instrument and an electronic mute insertable into the musical instrument, the electronic mute having a sensor, inserting the electronic mute into the musical instrument, detecting, via the sensor, the position of the electronic mute relative to the musical instrument, and enabling or disabling a feature of the electronic mute based on the position of the electronic mute relative to the musical instrument.

In some embodiments, the sensor may comprise an accelerometer and the position of the electronic mute may be determined by detecting movement of the electronic mute via the accelerometer. The sensor may also be a pressure-activated switch, wherein the position of the electronic mute may be determined by contact pressure between the electronic mute and the musical instrument being transduced by the pressure-activated switch.

In another embodiment, the sensor may be a proximity sensor and the position of the electronic mute may be determined by detecting the proximity of the electronic mute relative to the musical instrument.

The above summary of the present invention is not intended to describe each embodiment or every implementation of the present invention. The Figures and the detailed description that follow more particularly exemplify a preferred embodiment.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
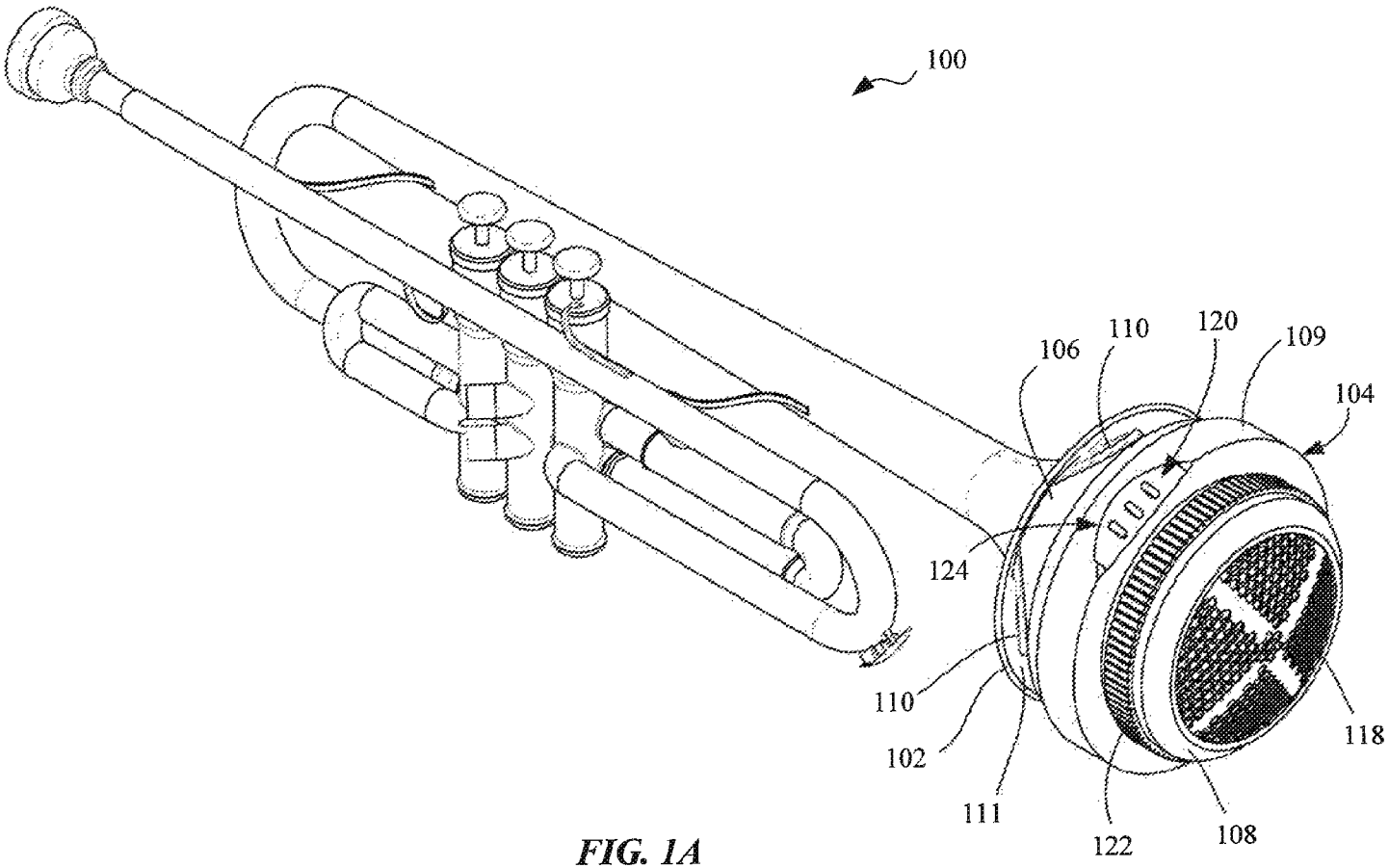
FIG. 1A is a view of a trumpet having a mute according to an embodiment of the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to a mute attachable to a musical instrument. In an example embodiment, the mute may be configured to be inserted into the bell of a brass instrument. An end of the mute that is inserted into the bell may comprise at least one microphone configured to sense sound generated by the instrument and a surface material or connecting feature that touches the bell, thereby securing the mute to the bell and at least partially muting the instrument. Another portion of the mute comprises at least one speaker (e.g., loudspeaker) used to emit sound received by the microphone.

A microcontroller may be used to receive the microphone signal and reproduce the signal using the speaker using digital signal processing (DSP). The microcontroller may be used to electronically modify or reproduce sounds made by the instrument in a variety of different ways. For example, the sound emitted from the instrument through the mute may have volume or loudness controlled by the microcontroller. The microcontroller may also change pitch, tone, timbre, modulation, or other characteristics of the transduced sound signal, and may apply filters to the sound such as notch (i.e., band-stop), band-pass, low-pass, or high-pass filters. In some arrangements, the microcontroller may record sound produced by the instrument and then play back the recording, such as, for example, by playing a looped recording. The musician may also play the instrument over the looped recording or in combination with the looped recording. A lighted indicator may be used to show settings of the microcontroller or to indicate characteristics of the sound generated by the musical instrument.

The mute may also comprise an external control feature that is accessible while the instrument is being played such as at least one button, lever, or ring. The external control feature may be used to control the microcontroller, such as, for example, by controlling the characteristics of the sound produced by the speaker or starting/stopping recording. Some mute embodiments may have additional or alternative control features such as at least one gyroscope or accelerometer which may be used to control the microcontroller based on the orientation or movement of the mute. Other control features may include a barometric pressure sensor for control based on pressure and a remote control transceiver for controlling the microcontroller using a remote control.

A remote control may comprise a circuit attachable to the instrument using an elastic band, adhesive, or other method of attachment. This may be beneficial in keeping the remote control easily accessible to the musician, especially in cases where the mute is used in large instruments such as a tuba or baritone and access to the bell may be difficult or limited. The remote control may communicate with the microcontroller of the mute using a wireless or wired communication interface. In at least one embodiment, the remote control may be an external computing device, such as a smartphone, personal computer, tablet computer, or the like.

A wireless interface in the mute may also be used to communicate with other devices, such as, for example, other mutes in musical instruments. With a plurality of mutes intercommunicating, an ensemble of musicians may produce modulated or mixed similarly and simultaneously. A conductor or other leader of a group of musicians may use a remote to control the output of multiple instruments at once to produce synchronization of frequency shifts between the instruments or synchronization of recording and playback functionality of multiple mutes.

In some configurations, a mute may also include an external microphone that is positioned in a manner allowing transduction of sound produced external to the musical instrument, such as, for example, for transducing sounds from other instruments or other parts of the same instrument.

Internally, the mute may provide for automatic correction to fix any change in pitch that the mute itself causes. It may also provide a means for shifting the pitch, timbre, or total harmonic distortion (THD) of the output sound using the control feature (e.g., sliding ring) in real time.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various embodiments shown herein relate particularly to brass instruments such as, for example, trumpets, tubas, bugles, french horns, and trombones, but those having ordinary skill in the art will appreciate that embodiments of the present disclosure may be applicable to other types of instruments, such as, for example, woodwinds (e.g., clarinets, oboes, bagpipes, flutes, saxophones, recorders, and bassoons).

Figure 1B:
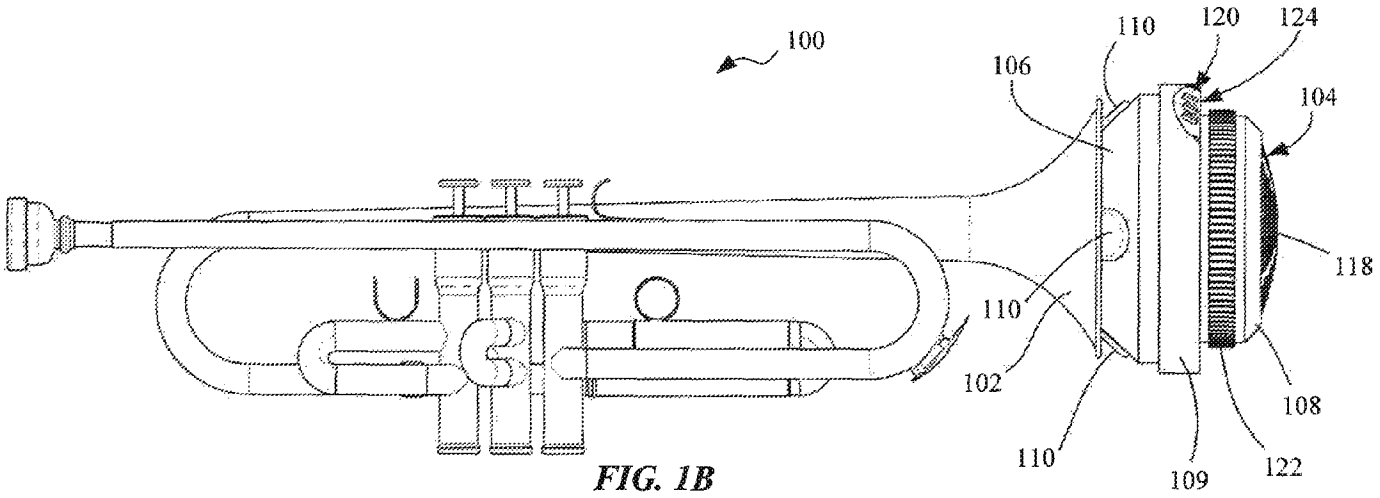
FIG. 1B is a side view of the trumpet and mute of FIG. 1A.
Figure 1C:
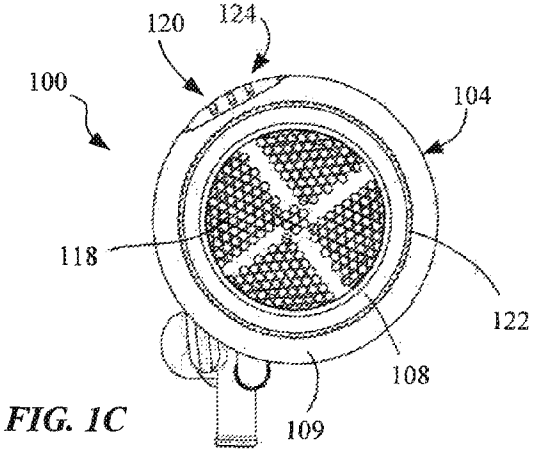
FIG. 1C is a front end view of the trumpet and mute of FIG. 1A.
Figure 2B:
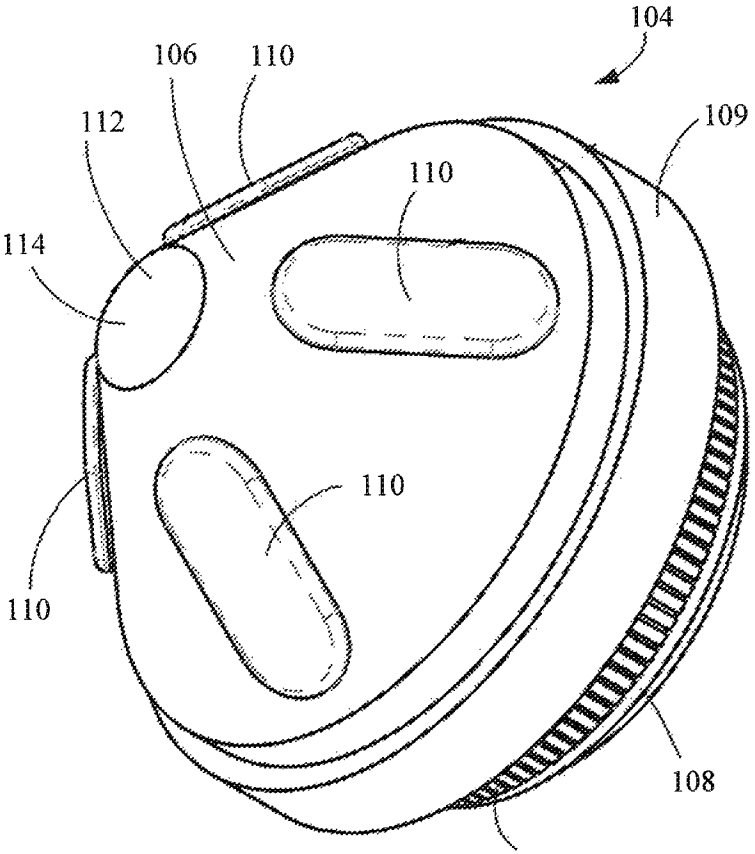
FIG. 2B is a rear perspective view of the mute of FIG. 2A.
Figure 2A:
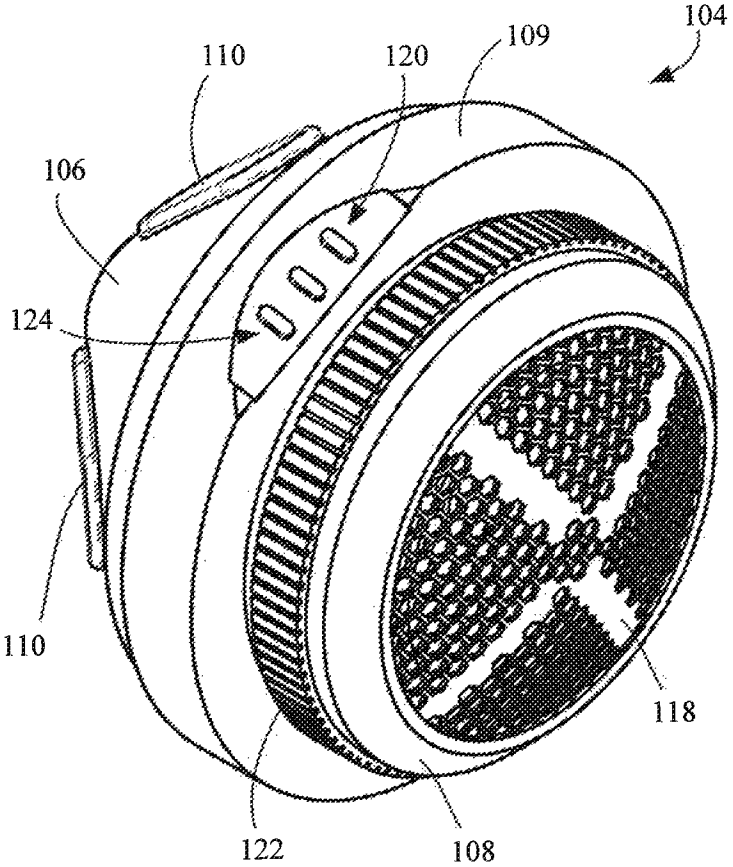
FIG. 2A is a front perspective view of a mute according to an embodiment of the present disclosure.
Figure 3:
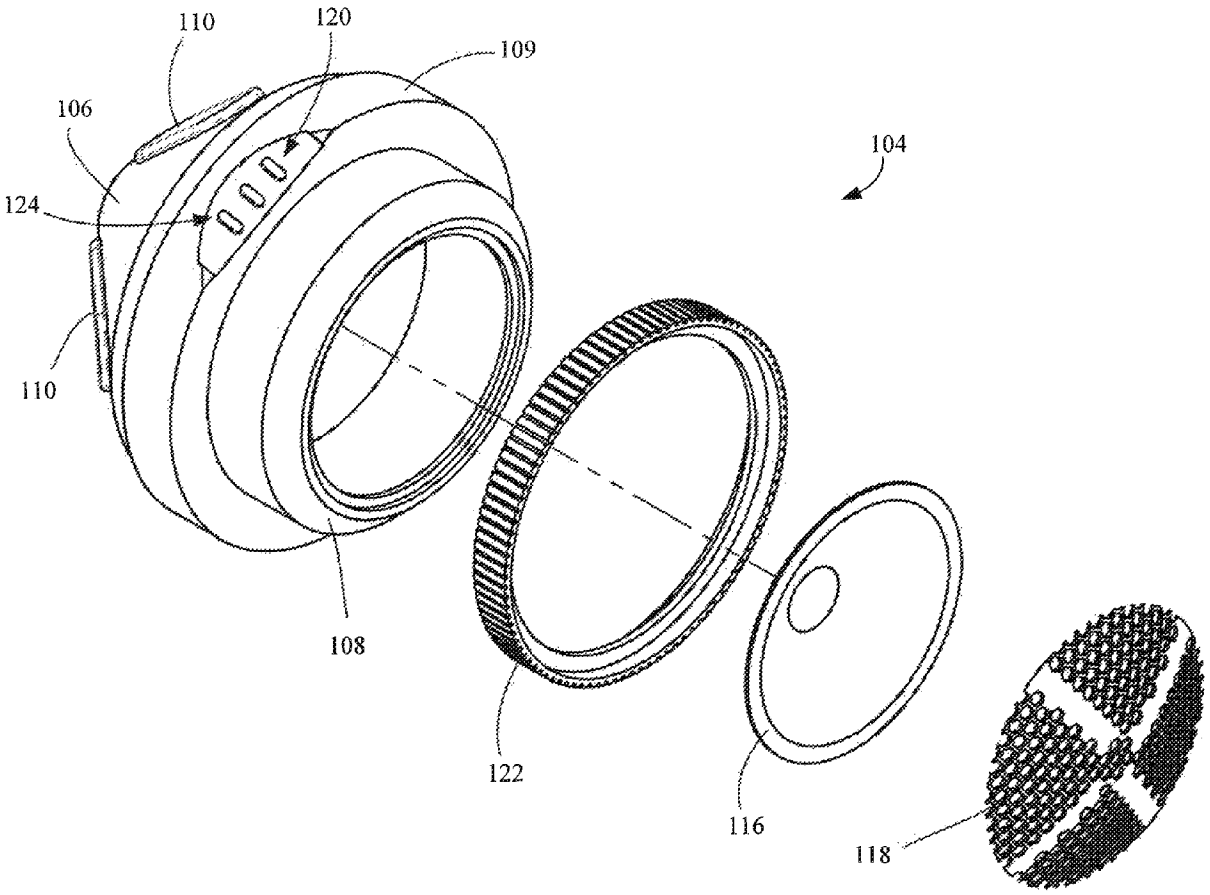
FIG. 3 is an exploded view of the mute of FIG. 2A.

Certain features and abilities of embodiments of the mute may be shown in connection with the figures. FIGS. 1A-1C show views of a trumpet 100 according to an embodiment of the present disclosure. The trumpet 100 may comprise a bell 102 or horn in which a mute 104 is held. The mute 104 may be inserted at least partially into the bell 102. As shown in connection with FIGS. 2A, 2B, and 3, the mute 104 may have an inserted end 106 (i.e., proximal end portion) and an external end 108 (i.e., distal end portion) of a mute body 109. The inserted end 106 may be inserted within the bell 102 of the trumpet 100, and the external end 108 may extend outward relative to the bell 102. In some embodiments, the entire mute 104 may fit within the bell 102. This may particularly be the case with large instruments having large bells.

The inserted end 106 of the mute 104 may be generally conical or frusto-conical in shape. Thus, the shape of the inserted end 106 may generally conform to the interior shape of a musical instrument, such as, for example, the interior of the bell 102 of the trumpet 100. The exterior of the mute 104 may comprise a plurality of pads 110. The pads 110 may be positioned distributed circumferentially around the external surface of the mute 104, such as around the inserted end 106 of the mute. The pads 110 may be configured to physically touch the interior of the bell 102 of the instrument and may comprise a material such as, for example, rubber, silicone, cork, or another similar compressible or high-friction material. Thus, the pads 110 may keep the mute 104 retained in the bell 102 by a friction or interference fit with the internal surface 111 (see FIG. 1A) of the bell 102. Using a friction or interference fit may also confer the benefit of quickly removing or attaching the mute 104 while the instrument is being played since there are no clips or other interlocking parts to attach or remove from the instrument to keep the mute 104 in place. In some embodiments, suction cups or a similar negative pressure device may be used in place of the pads 110 to secure the mute 104 to the bell 102.

In the embodiments shown in FIGS. 1A-3, the pads 110 provide some separation between the bell 102 and the mute 104 so as to not completely occlude the bell 102. Thus, air may be expelled from the bell 102 between the pads 110. In some embodiments, the inserted end 106 may have circumferentially arranged material that completely blocks the bell 102 opening through complete and continuous contact with the bell 102 around an outer circumference of the inserted end 106.

At least one microphone 112 may be positioned at the inserted end 106 of the mute 104. The microphone 112 may be positioned to transduce sound coming from the instrument. In some embodiments, a plurality of microphones may be provided at the inserted end 106. In some cases, multiple microphones may all be at the internal tip 114 of the mute 104, and in some cases one or more microphones may be positioned around the periphery of the inserted end 106 and/or at the internal tip 114. The at least one microphone 112 may be beneficially selected to properly transduce sound coming from the instrument to which the mute 104 will be attached. For example, the microphone 112 may be configured to transduce the frequencies and loudness of the sound produced by the instrument to which the mute 104 will be attached.

The external end 108 of the mute 104 may comprise at least one speaker 116. See FIG. 3. The speaker 116 may be configured to protrude from the bell 102 to enhance its ability to project sound away from the bell 102. The speaker 116 may be configured to reproduce sound generally imitating the range of frequencies and loudness of the instrument to which it is attached. The mute 104 may also comprise a grille 118 to protect the speaker 116.

The external end 108 of the mute 104 may also comprise a plurality of control and indicator features. In the pictured embodiment of FIGS. 1A-3, the control features may comprise buttons 120 and a rotatable ring 122. Indicator features may comprise lights such as light-emitting diode (LED) indicator lights 124. The buttons 120 may be used to input settings and operating modes for the mute 104, such as, for example, providing power (i.e., on/off) control, sound characteristic settings, and control over the operation of various components of the mute 104 such as an internal gyroscope, accelerometer, pressure sensor, or similar component in the mute 104. See also the sensors 512 of FIG. 5. In some embodiments, the lights 124 may also be buttons 120, wherein the light coming from the buttons 120 indicates a status of a feature of the mute 104 at a glance. In some arrangements, lights are provided for aesthetic effect. For example, lights may be positioned in or around the speaker 116 or the rotatable ring 122.

The rotatable ring 122 at the external end 108 of the mute 104 may extend circumferentially around the perimeter of the external end 108. In the embodiment of FIGS. 1A-3, the rotatable ring 122 extends around the perimeter of the grille 118 and the speaker 116. The rotatable ring 122 may beneficially be accessible by hand while the mute 104 is positioned in the bell 102 of the trumpet 100. Thus, the ring 122 may extend from the bell 102 and may be laterally exposed relative to the bell 102. When a musician plays the instrument, he or she may grasp the ring 122 and rotate it around the external end 108 of the mute 104 to provide an additional type of control over the sound produced by the mute 104, such as by turning the ring 122 to increase or decrease the volume of the sound coming from the speaker 116, modulating the sound, adjusting timbre, and/or other potential modifications discussed elsewhere in this document.

The rotatable ring 122 may provide input to a potentiometer or a rotary/optical encoder of the mute 104. For example, the rotatable ring 122 may comprise an optical pattern on an inner surface of the ring so that an optical encoder may measure its movement or determine its position. Alternatively, the rotatable ring 122 may contact a rotary encoder that moves when the ring is turned and thereby measures the ring's movement. In this manner, the position of the rotatable ring 122 may be determined relative to the rest of the mute body 109. In some embodiments, a plurality of rotatable rings 122 may be provided, wherein the positions of each of the plurality of rotatable rings 122 may be individually detected relative to the mute body 109. Each ring of the plurality of rings may provide a different type of control and command for operating the mute 104. See also FIG. 6A-6D.

Figure 4:
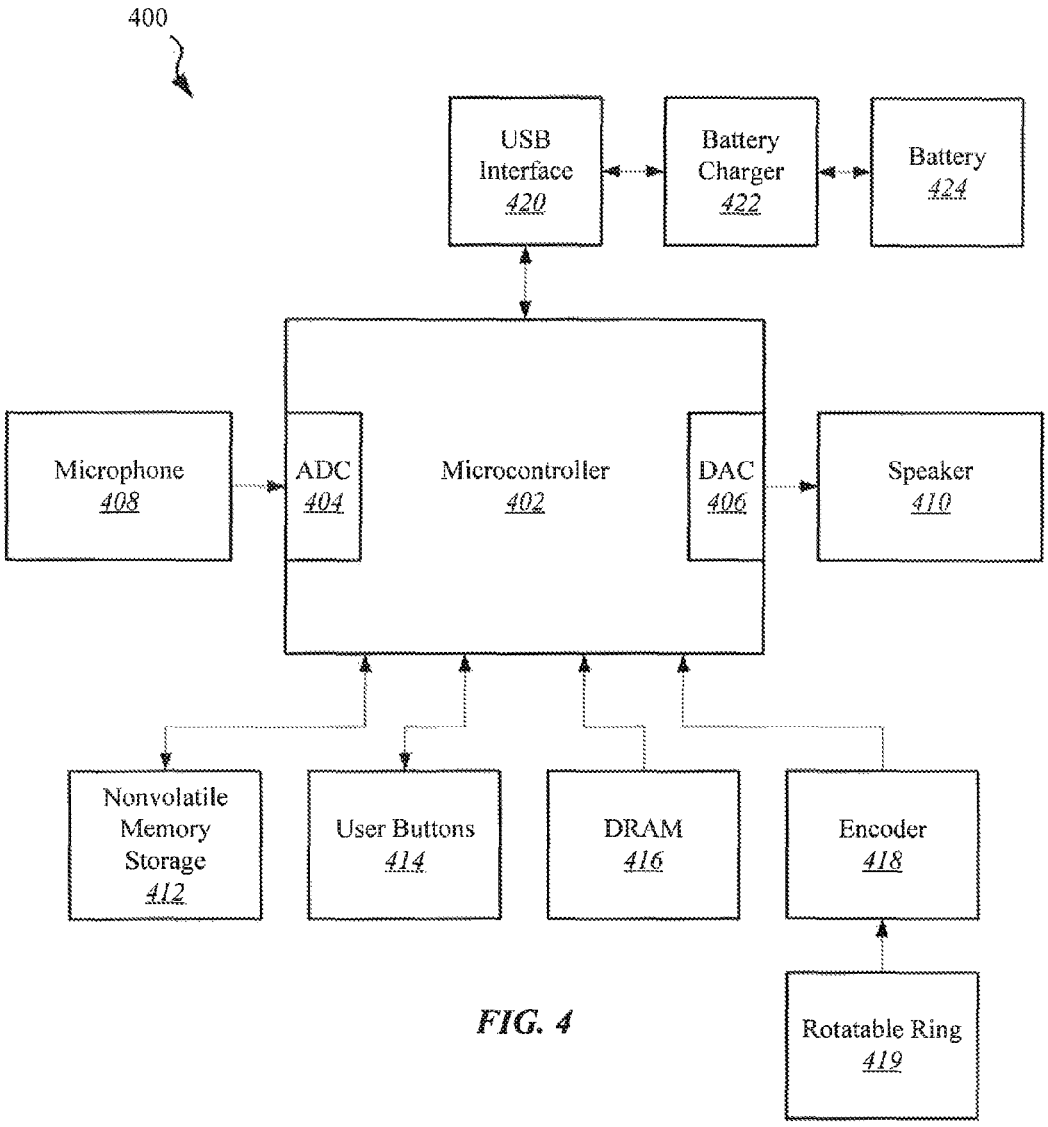
FIG. 4 is a block diagram of a circuit and other components used in a mute according to another embodiment of the present disclosure.

FIG. 4 is a block diagram of an exemplary embodiment of an instrument mute 400 of the present disclosure. The mute 400 may be a mute 104 described above in connection with FIGS. 1A-3. The mute 400 may comprise a microcontroller 402 having an analog-digital converter (ADC) 404 and a digital-analog converter (DAC) 406. The ADC may receive input from a microphone 408 (e.g., microphone 112), and the DAC may provide output to a speaker 410 (e.g., a loudspeaker). The microcontroller 402 may also be linked to nonvolatile memory storage 412, user buttons 414, dynamic random access memory (DRAM) 416, an encoder 418 and rotatable ring 419 (e.g., rotatable ring 122), and a universal serial bus (USB) interface 420. The USB interface 420 may link a battery charger 422 and battery 424 to the microcontroller 402 to provide power for the mute 400. The battery 424 may be positioned within the housing of the mute 400 (e.g., in the mute body 109) to provide power to the electronic components.

Using these components, the mute 400 may provide digital signal processing (DSP) that can control, modulate, and change the incoming sound from the instrument (via the microphone 408) before playing the sound through the speaker 410 output. For example, the mute 400 may provide correction (e.g., auto-correction) of changes in pitch that may be caused by the attachment of the mute 400 itself to the instrument or due to the characteristics of the microphone 408 and speaker 410. In another example, the mute 400 may shift the pitch of output sound according to the relative position of the rotatable ring 419. In some arrangements the mute 400 may be controlled to change the timbre and total harmonic distortion (THD) of the output sound in real time (e.g., while the instrument is being played). The mute 400 may provide digital filtering and provide notch, band-pass, low-pass, high-pass, and other related types of filters for the output sound.

In some embodiments, the mute 400 may be configured to record and reproduce tracks, samples, or loops of sound coming from the instrument, the mute itself, or from another source (e.g., from the artist playing the instrument or from another instrument). The recorded tracks, samples, or loops may then be transferred to another device (e.g., using USB interface 420 or a communication transceiver 514 (see FIG. 5)) and/or may be replayed using the speaker 410. The recorded signals and settings of the microcontroller 402 may be preserved using the nonvolatile memory storage 412 and/or the DRAM 416. In some configurations, the instrument may be played concurrently with the output of the recorded track or sample. The live sound of the instrument may concurrently be controlled and played using the mute 400 and speaker 410 while the recorded track or sample is replayed, or the live sound of the instrument may simply be played while the mute 400 only outputs the recording. The control features of the mute 400 (e.g., user buttons 414 and rotatable ring 419) may be used to control how and when the recorded samples are replayed, such as, for example, by controlling their pitch, volume, timing, modulation, timbre, and other acoustic characteristics.

Figure 5:
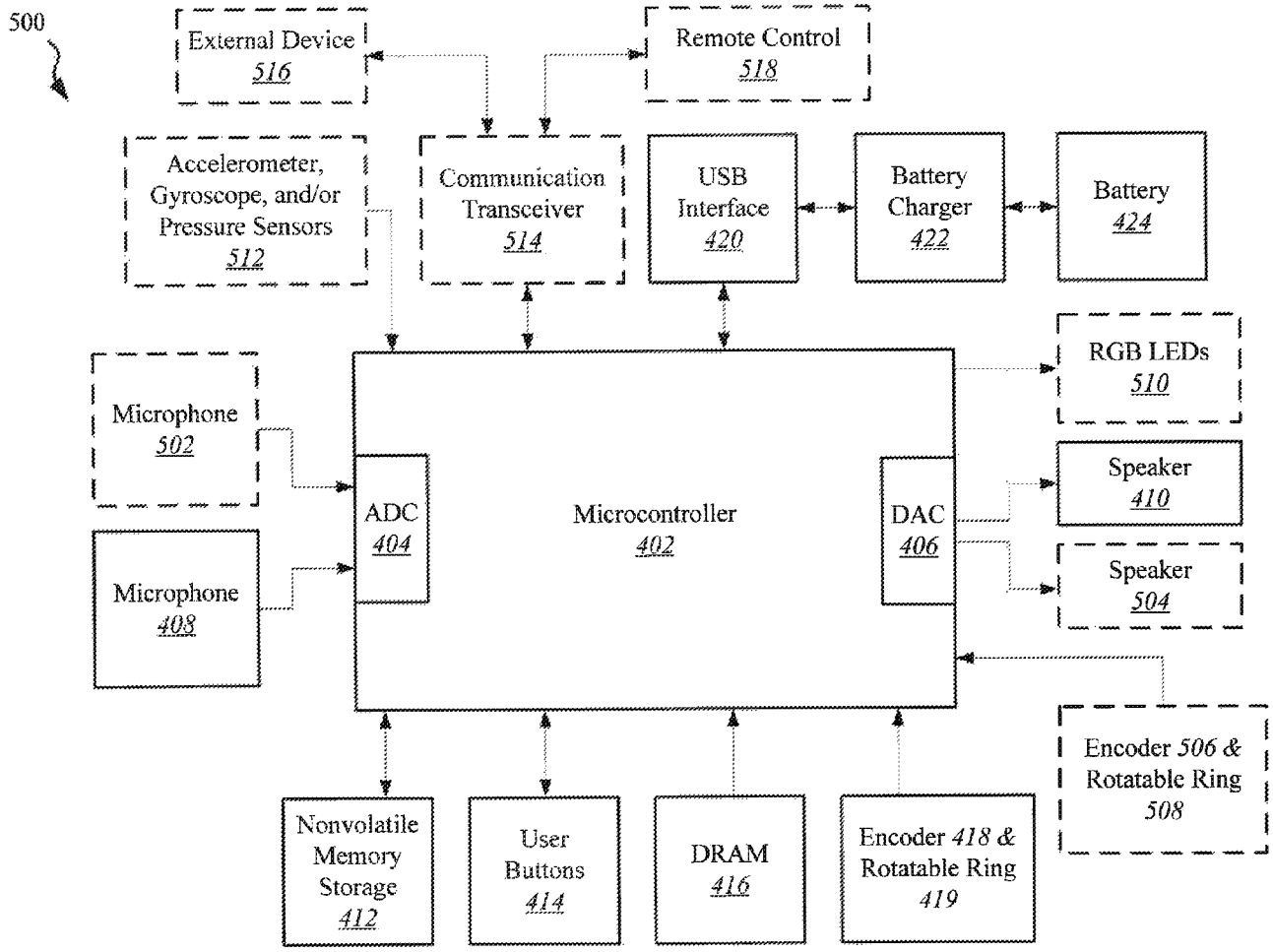
FIG. 5 is a block diagram of another circuit and other components used in a mute according to another embodiment of the present disclosure.
Figure 6A:
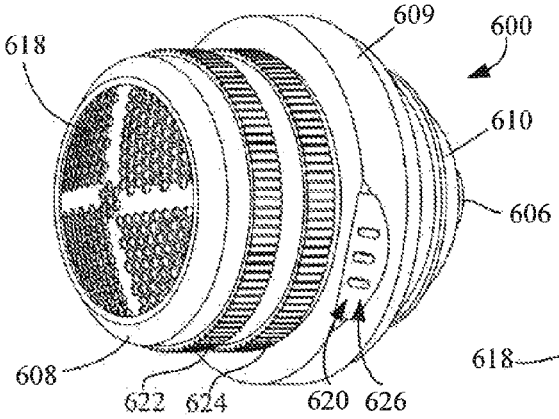
FIG. 6A is a perspective view of an embodiment of a musical instrument mute according to another embodiment of the present disclosure.
Figure 6B:
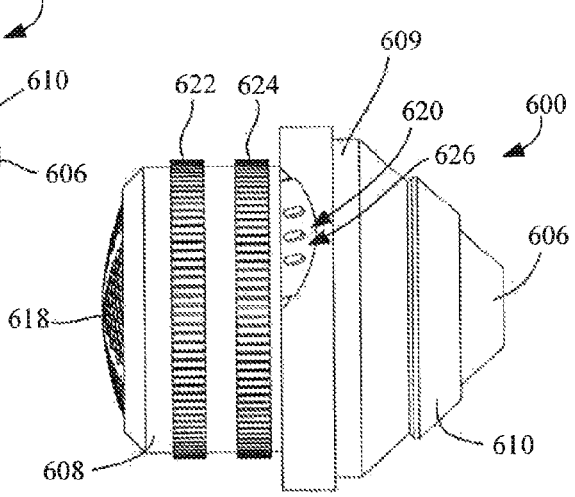
FIG. 6B is a side view of the mute of FIG. 6A.
Figure 6C:
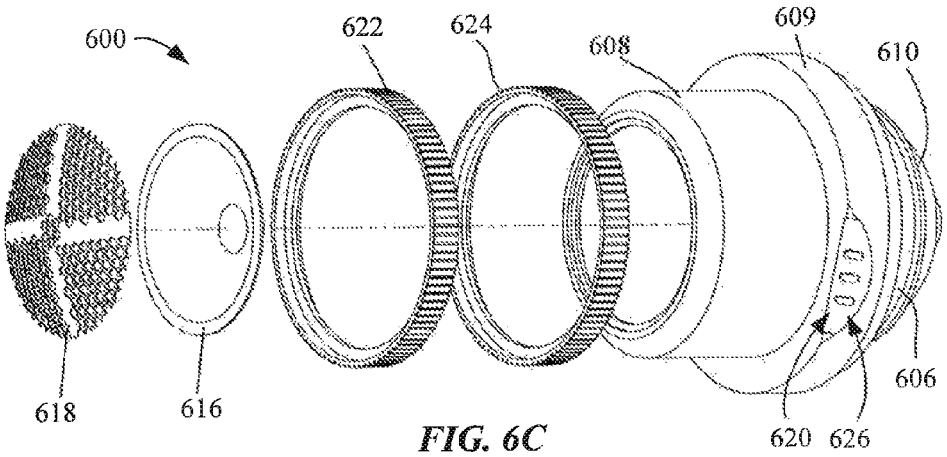
FIG. 6C is an exploded view of the mute of FIG. 6A.
Figure 6D:
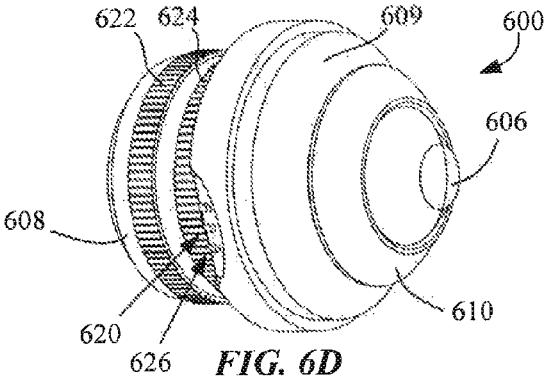
FIG. 6D is a perspective rear view of the mute of FIG. 6A.

FIG. 5 shows another embodiment of a mute 500 of the present disclosure. This embodiment shows a mute 500 having a plurality of various additional features and elements which may be separately, partially collectively, or completely collectively implemented in a mute 500. Some of these components may comprise at least one additional microphone 502, speaker 504, and/or encoder 506 and rotatable ring 508. The additional microphone 502 may allow the mute 500 to receive input from the ambient/external area around the mute 500 and/or may be used in addition to the other microphone 408 to transduce sound coming from the instrument. The additional speaker 504 may allow stereo output from the mute 500 or may be tuned to produce frequencies that the other speaker 410 is not optimized to reproduce (e.g., high treble or low bass frequencies). In some embodiments, the additional speaker 504 may reproduce recorded sounds and the other speaker 410 may reproduce live sounds, or vice versa. The additional encoder 506 and rotatable ring 508 may provide an extra way for the musician to control the mute 500 and the output of the mute 500. For example, one ring 419 may be used to control volume and another ring 508 may be used to control modulation or pitch. In some embodiments, microphone 502 may comprise a plurality of microphones, and speaker 504, encoder 506, and rotatable ring 508 may respectively comprise a plurality of their components.

The mute 500 may also provide LEDs 510, such as red-green-blue (RGB) LEDs, as discussed above in connection with LED indicator lights 124. These RGB LEDs may provide color-based feedback to the performer or to other viewers by providing aesthetic accent to the mute 500 or by indicating settings of the microcontroller 402. For example, brightness of the LEDs 510 may indicate a volume setting of the mute 500, or a range of colors provided by the LEDs 510 may indicate a pitch or timbre adjustment setting. In another embodiment, the LEDs 510 may blink to provide a metronome or may pulse in response to notes played by the artist.

Some embodiments of the mute 500 may comprise one or more sensors 512 such as an accelerometer, gyroscope, and/or barometric pressure sensor. The sensors 512 may transduce signals and provide the signals to the microcontroller 402 to control various characteristics of the sound output by the mute 500. Using an accelerometer, the mute 500 may transduce acceleration of the mute 500 or orientation of the mute 500 with respect to the local gravity field and thereby change the sound output based on movement of the mute. For example, tilting the mute 500 upward may cause the microcontroller 402 to increase pitch due to feedback from the accelerometer, and tilting downward may decrease pitch accordingly. Using a gyroscope, the mute 500 may detect rotational velocity as another control input for the sound output. Similarly, atmospheric pressure around the mute 500 may be determined using a barometric pressure sensor and the mute 500 may accordingly adjust pitch or other characteristics in response. Thus, the mute 500 may compensate for different atmospheric pressure conditions. These sensors 512 may in some cases be microelectromechanical systems (MEMS) components to reduce weight and size within the mute 500.

In some embodiments, the electronic mute may be controlled at least in part by one or more sensors in the device, such as, for example, the accelerometer, gyroscope, and/or pressure sensors 512 based on the position of the mute 500 relative to another reference point, such as the portion of the musical instrument to which the mute 500 is inserted. With an accelerometer, the position of the mute 500 relative to the musical instrument may be determined by detecting and calculating movement of the electronic mute. For example, the mute 500 may be calibrated to a "home position" wherein the mute is lodged in a bell or horn of the musical instrument, and the three-dimensional position of the mute 500 may be tracked if the mute is moved or withdrawn from the bell or horn. Alternatively, the accelerometer may be used to track an angular orientation of the mute 500 with respect to the local gravity field, such as by determining whether the mute is laid speaker-down on a table or whether it is rotated into a typical range of angles that it would be in while the instrument is being played. For example, the accelerometer may detect whether the mute is positioned with its central axis extending horizontally within a range of plus or minus about 45 degrees for a trumpet or other substantially horizontally extending bell or horn instrument, or the accelerometer may detect whether the mute is positioned with its central axis extending vertically and with the speaker point upward within a range of plus or minus 45 degrees for a tuba or other substantially vertically extending bell or horn instrument. Repositioning the mute may induce the microcontroller 402 to turn off the mute, enable or disable features of the mute such as disabling the encoder 418 and rotatable ring 419 or enabling a mute function that prevents sound from being produced by the speaker 410. Other features of the mute that may be controlled by the relative position or angle of the mute, such as the modulation, pitch, or other characteristics of the sound output, as will be understood by those having ordinary skill in the art and having the benefit of the present disclosure.

In other embodiments, the sensors 512 may comprise one or more pressure sensor or pressure-activated switch. This sensor or switch may indicate to the microcontroller 402 whether the mute 500 is pressed into contact or engages the bell or horn of the musical instrument. Thus, the condition of the sensor or switch may control features of the mute 500 similar to those described above in connection with an accelerometer. A pressure sensor or pressure-activated switch may be positioned in the pads (e.g., 110, 610) of the mute so that pressure against the pads registers the position of the mute.

One or more proximity sensor may also be used to control the mute 500. A proximity sensor may be included in the sensors 512. For example, a proximity sensor may be an infrared (IR) reflection sensor configured to sense reflected IR signals and thereby determine whether the mute 500 is near or touching a surface of the musical instrument when it is inserted into the musical instrument.

Using the sensors 512, the mute 500 may therefore be controlled by inserting the mute into the musical instrument, detecting, via the sensors 512, the position of the mute relative to the musical instrument, and controlling (e.g., enabling, disabling, or changing) a feature of the electronic mute based on the position of the electronic mute relative to the instrument.

In some arrangements, the mute 500 may comprise a communication transceiver 514. The transceiver 514 may be a wired transceiver or wireless transceiver such as an infrared, radio, BLUETOOTH®, or WI-FI® transceiver. The mute 500 may thereby communicate with another external device 516 and/or a remote control 518 using the transceiver 514. An external device 516 may be another electronic instrument mute or a remote electronic device such as a computer or smartphone. For example, the mute 500 may intercommunicate with other electronic mutes in order to provide group effects such as synchronized frequency shifting/correction or synchronized recording or playback of multiple instruments. A conductor of a group of interlinked mutes may also participate in mixing and modulating the various instruments live and remotely. These external devices 516 may each comprise sensors (e.g., sensors 512).

A remote control 518 may be provided with the mute 500 to provide additional or alternative control options for the user. For example, a remote control may be a separate electronic device attached to the instrument at a position different from the bell (e.g., bell 102). A remote control 518 may therefore be particularly beneficial in instruments where a mute may be difficult to reach in a bell, such as in a tuba or baritone, since the remote control 518 may provide control functionality for the mute 500 without having to physically interact with the mute body (e.g., mute body 109). The remote control 518 may attach to the instrument using a clip, strap/band (e.g., elastic band), adhesive, or another comparable type of attachment means. The remote control 518 may be a wireless device (e.g., a smartphone) or may be wired to the mute 500 (with or without the transceiver 514). The remote may be self-powered (e.g., using a battery) or may be powered via the communication medium used with the transceiver 514. The remote control 518 may beneficially include buttons and a sliding/rotatable ring for control, similar to the buttons 414 and ring 419 on the mute 500. In some embodiments, the mute 500 may not have buttons 414 or a ring 419, and these control features may only be found on the remote control 518. The remote control 518 may in some cases comprise a foot pedal or foot button configured to manipulate control characteristics based on a pedal or button position controlled by the artist's foot. A remote control 518 may also comprise sensors 512 to allow an alternative means of control over the output of the mute 500.

FIGS. 6A-6D show another embodiment of a musical instrument mute 600 having a plurality of control features. The mute 600 may have a mute body 609, speaker 616, grille 618, buttons 620, and LED lights 626. In this embodiment of the mute 600, two rotatable rings 622, 624 are positioned at the external end 608 of the mute 600. Thus, the user may manipulate more than one rotatable ring 622, 624 while the musical instrument mute 600 is operated. Each of the plurality of rotatable rings 622, 624 may control different effects or characteristics of the mute 600, such as, for example, one ring 622 controlling volume and another ring 624 controlling pitch. In the pictured embodiment, the rings 622, 624 are concentric and positioned at different axial positions along the mute 600. The rings 622, 624 also have equal diameters and matching outer shapes and textures. In other embodiments, the rings 622, 624 may have unequal diameters and their outer shapes and textures may differ. This may in some cases provide easier identification by the user's hand, such as may be the case when the mute 600 is not visible to the user.

The mute 600 of FIGS. 6A-6D also has a pad 610 that extends in a ring around a circumference of an inserted end 606 of the mute. The pad 610 may therefore completely occlude an opening in a bell or horn of a musical instrument. The pad 610 may comprise a cork, foam, or other flexible or compressible material to allow the mute 600 to seal the bell or horn opening on contact. The material used may also improve the friction between the pad 610 and the instrument in order to help keep the mute 600 from inadvertently slipping out of the bell or horn.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A method of controlling an electronic mute for a musical instrument, the method comprising:
   providing a musical instrument and an electronic mute insertable into the musical instrument, the electronic mute having a sensor;
   inserting the electronic mute into the musical instrument;
   detecting, via the sensor, the position of the electronic mute relative to the musical instrument;
   controlling a feature of the electronic mute based on the position of the electronic mute relative to the musical instrument.

2. The method of claim 1, wherein the sensor is an accelerometer and wherein the position of the electronic mute is determined by detecting movement of the electronic mute via the accelerometer.

3. The method of claim 1, wherein the sensor is a pressure-activated switch and wherein the position of the electronic mute is determined by contact pressure between the electronic mute and the musical instrument being transduced by the pressure-activated switch.

4. The method of claim 1, wherein the sensor is a proximity sensor and wherein the position of the electronic mute is determined by detecting the proximity of the electronic mute relative to the musical instrument.

5. The method of claim 1, wherein the sensor is a pressure sensor and the feature is the output pitch of the electronic mute.

6. A method of controlling an electronic mute for a musical instrument, the method comprising:
   providing a musical instrument, an electronic mute insertable into the musical instrument, and a remote device, the electronic mute having a controller in electronic communication with the remote device;
   inserting the electronic mute into the musical instrument;
   receiving, at the controller, a signal from the remote device;
   controlling a feature of the electronic mute based on the signal from the remote device, wherein controlling the feature of the electronic mute comprises modifying a pitch, tone, timbre, total harmonic distortion (THD), or modulation of sound produced by the electronic mute.

7. The method of claim 6, wherein the remote device is in wireless electronic communication with the controller and the signal is a wireless signal.

8. The method of claim 6, wherein the remote device is in wired electronic communication with the controller and the signal is a wired electrical signal.

9. The method of claim 6, further comprising controlling the remote device.

10. The method of claim 6, wherein the remote device is a computing device.

11. The method of claim 6, wherein the remote device is mounted to the musical instrument.

12. The method of claim 6, wherein the remote device is on a second musical instrument.

13. The method of claim 12, wherein the remote device is a second electronic mute.

14. The method of claim 6, wherein the remote device is in synchronized electronic communication with a plurality of electronic mutes.

15. The method of claim 6, wherein the remote device comprises a pressure sensor.

16. The method of claim 6, wherein the electronic mute comprises a lighting device and wherein controlling the feature of the electronic mute comprises controlling the lighting device.

17. A method of controlling an electronic mute for a musical instrument, the method comprising:
   providing a remote device;
   electronically connecting a plurality of electronic mutes to the remote device, the electronic mutes being insertable into musical instruments;
   generating an electronic signal at the remote device, the electronic signal being communicated to the plurality of electronic mutes to control a feature of the plurality of the electronic mutes.

18. The method of claim 17, wherein the electronic signal is configured to adjust sound generated by the plurality of electronic mutes.

19. The method of claim 17, wherein the electronic signal is configured to control recording or playback functionality of the plurality of electronic mutes.

20. The method of claim 17, wherein the electronic signal is configured to adjust lighting on the plurality of electronic mutes.

21. A method of controlling an electronic mute for a musical instrument, the method comprising:
   providing a musical instrument, an electronic mute insertable into the musical instrument, and a remote device, the electronic mute having a controller in electronic communication with the remote device;
   inserting the electronic mute into the musical instrument;
   receiving, at the controller, a signal from the remote device;

controlling a feature of the electronic mute based on the signal from the remote device, wherein controlling the feature of the electronic mute comprises applying a digital filter to the sound produced by the electronic mute.

* * * * *